US007559380B1

(12) United States Patent
McKnight

(10) Patent No.: US 7,559,380 B1
(45) Date of Patent: Jul. 14, 2009

(54) TRAVELING SWIVEL FRAME ASSEMBLY WITH FIXED BRACKETS

(75) Inventor: Thomas Nelson McKnight, Austin, TX (US)

(73) Assignee: Eagle Rock Manufacturing, LLC, Midland, TX (US)

( * ) Notice: Subject to any disclaimer, the term of this patent is extended or adjusted under 35 U.S.C. 154(b) by 153 days.

(21) Appl. No.: 11/739,514

(22) Filed: Apr. 24, 2007

Related U.S. Application Data

(63) Continuation-in-part of application No. 11/735,522, filed on Apr. 16, 2007, now abandoned, which is a continuation-in-part of application No. 10/982,365, filed on Nov. 5, 2004, now abandoned.

(51) Int. Cl.
*E21B 19/08* (2006.01)

(52) U.S. Cl. ..... 175/203; 175/220; 166/77.1; 166/85.5

(58) Field of Classification Search ..... 166/75.11, 166/85.5, 77.1, 85.1; 175/85, 52, 203, 220
See application file for complete search history.

(56) References Cited

U.S. PATENT DOCUMENTS

| | | | |
|---|---|---|---|
| 3,747,402 | A | 7/1973 | Branham et al. |
| 3,917,230 | A | 11/1975 | Barron |
| 3,994,350 | A | 11/1976 | Smith et al. |
| 4,300,276 | A | 11/1981 | Davis |
| 4,407,629 | A | 10/1983 | Willis |
| 4,787,244 | A | 11/1988 | Mikolajczyk |
| 4,796,863 | A | 1/1989 | Reed |
| 4,842,250 | A | 6/1989 | Willis |
| 5,762,279 | A | 6/1998 | Horton, III |
| 2004/0069532 | A1 | 4/2004 | Keast |

FOREIGN PATENT DOCUMENTS

| | | | |
|---|---|---|---|
| WO | 9214028 | A2 | 8/1992 |

*Primary Examiner*—Giovanna C Wright
(74) *Attorney, Agent, or Firm*—Buskop Law Group, PC; Wendy Buskop

(57) ABSTRACT

A top drive unit guiding system for aligning a power swivel and for dissipating torque created by the power swivel. The guiding system has a first guide frame and a second guide frame, where the first and second guide frames are located on opposite sides of the power swivel. Each guide frame includes at least two wheels. Each wheel is adapted to dissipate torque created by the power swivel and align the power swivel to support guide. Each wheel is made from a hard segmented rubber, a non-segmented rubber, a rubber composite, a synthetic rubber, or combinations thereof. The wheels are mounted to at least two adjustable brackets, where one bracket is associated with each wheel, and where each bracket positions the wheel in relation to the support guide.

5 Claims, 8 Drawing Sheets

TRAVELING SWIVEL FRAME ASSEMBLY WITH FIXED BRACKETS

CROSS REFERENCE TO RELATED APPLICATIONS

The present application is a Continuation-in-Part of U.S. patent application Ser. No. 11/735,522 filed on Apr. 16, 2007 now abandoned, entitled: "TRAVELING SWIVEL FRAME ASSEMBLY WITH FIXED BRACKETS", which is a Continuation-in-Part of U.S. patent application Ser. No. 10/982,365, filed on Nov. 5, 2004 now abandoned, entitled: "TRAVELING SWIVEL FRAME ASSEMBLY WITH RUBBER WHEELS." Co-pending patent application Ser. No. 10/982,365 is incorporated herein by reference in its entirety.

FIELD

The present embodiments relate to even reeving systems for a top drive drilling system usable on drilling rigs.

BACKGROUND

A typical top drive earth drilling machine consists of substructure with a mast and drawworks mounted thereon. The traditional purpose of a mast is to support hoisting loads during the drilling operation. In the case of a top drive earth drilling machine, the mast may also be required to guide a traveling top drive unit and withstand the torque applied to the mast from the rotating drill pipe. A crown assembly consisting of an array of sheaves is attached to the top of a mast for the purpose of connecting a drilling line from a drawworks mounted on a substructure to a traveling top drive assembly. The relative orientation of the drawworks, crown sheaves, and traveling top drive assembly are designed to permit reeving the drilling line.

U.S. Pat. No. 4,842,250 teaches an earth drilling machine with a drawworks drum having axis of rotation perpendicular to the axis of rotation of all of the sheaves of the invention. The perpendicular orientation of the drum requires that the entire drawworks and drum must be angled to prevent wear on the drilling line. This is a very costly and time consuming operation because of the cost and labor associated with mounting the drawworks drum at an angle so that the drilling line does not create angle with the fast line sheave that would cause extensive wear.

U.S. Pat. No. 4,407,629 teaches a drilling machine with a system of inserting drilling pipe into place, from a horizontal position using an extensive clamping system.

A need exists for an earth drilling machine that does not require the drawworks to be mounted at an angle, and the embodiments described in this application meet these needs.

A need exists for a drilling machine with a system of efficiently placing the drilling pipe in place to be used.

The current art requires a band breaking system that requires water to cool the system and prevent over heating and damage. A need exists for a rotary drilling rig that uses a simpler more efficient breaking system.

A need exists for a more reliable drilling rig system, with less wear on the wire line and the wire line sheaves.

A need exists for an earth drilling machine with higher reliability than other types of drilling rigs. The embodiments of the traveling swivel frame assembly of the present invention meet that need.

A need exists for a traveling swivel frame for an earth drilling rig, with less wear on the wire line and the wire line sheaves.

A need exists for a traveling swivel frame structure that creates less stress on the drilling rig from the vibrations of the drilling mechanism.

The present embodiments meet these needs.

BRIEF DESCRIPTION OF THE DRAWINGS

The detailed description will be better understood in conjunction with the accompanying drawings as follows.

Figure 1:
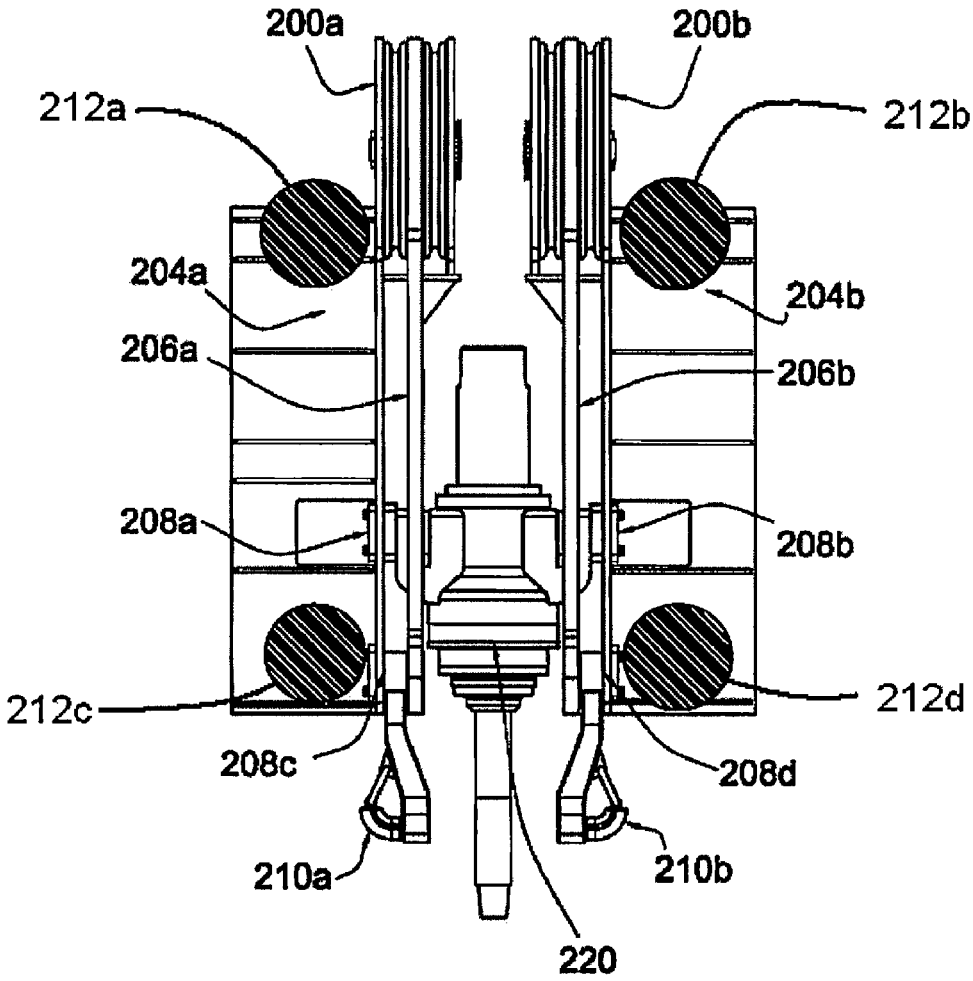
FIG. 1 depicts a view of the back of the traveling swivel frame assembly according to the invention showing the wheels of the invention.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that it can be practiced or carried out in various ways.

The embodied traveling swivel frame assembly saves energy by providing a frame assembly that has less wear and shock loads on the mast as compared to other known traveling frame assemblies because of the type and location of the wheels used in the assembly. The wheels are placed at set distance that correspond to the need of the use. The distance of the wheels are set using a fixed axel.

The use of large diameter wheels enables more load to be distributed over a larger area and provides a means for providing side load shock absorbance from the power swivel. Using the large diameter wheels enables produces a safer rig, less likely to fail due to vibrations caused during drilling.

The traveling swivel frame assembly saves energy by combining (1) a hoisting device and (2) a drilling mechanism support device in one unit.

The embodied traveling swivel frame provides a safety feature since the frame assembly can absorb energy, namely shock loads placed on a power swivel held by the traveling frame. Stress is equally divided onto both sides of the frame assembly. The entire load is kept aligned with the present invention, which prevents offset stress, and stops the creation of bending moments in the assembly. The present embodiments involves a traveling assembly that pulls straight, reducing the possibility of damage, increasing safety, and also lowering the cost of operation of the equipment.

The embodied system includes a top drive earth moving machine, namely a drilling rig that moves with less than ½ the load required to transport a conventional drilling rig. This machine has a lighter weight design compared to conventional designs. In an embodiment, the earth moving machine is up to 50% less than the weight of a comparable drilling machine using a rotary table. The lightweight embodiments of the drilling machine require only half the number of transport trucks typically needed to move the rig from one location to another, thereby saving numerous gallon of expensive diesel fuel. The rig uses about 450 gallons per day of diesel, which is considerably less than comparable conventional drilling rigs with rotary tables.

The embodied drilling machine saves energy by providing an embodiment that utilizes a unique braking system that utilizes less fossil fuel and/or electricity to stop than conventional drilling systems. Additionally, the brakes do not require an external cooling system, thereby saving large amounts of energy that are typically required by conventional braking system.

The present embodiments save lives and costs by requiring only a two man crew to rig up and operate the rig. Most conventional rigs require at least a four man crew to transport and set up and operate the rig. The present embodiments require only a driller and a helper. Conventional rigs typically require a driller, a helper, a tong operator, and a derrick man for racking pipe.

The embodied system is more reliable with less wear on the wire line and the wire line sheaves, thereby eliminating the need for extra sheaves and eliminating the need for a drawworks drum at an angle due to utilizing the even reeving system.

The embodied system, when used in a top drive rig, provides more reliable drilling rig system, with less wear on the wire line and the wire line sheaves.

The traveling swivel frame can lessen the stress on the drilling rig created by the vibration of a drilling mechanism.

The embodiments include a frame that is easily repaired in the field because all the sheaves of the traveling frame are the same diameter and travel on the same axis.

With reference to the figures, FIG. 1 depicts the back side of a traveling swivel frame assembly and includes four wheels (212*a*, 212*b*, 212*c*, 212*d*) attached to a guide frame (204*a* and 204*b*) of the traveling swivel frame assembly. The wheels are connected in pairs using a fixed length axel. The first and the second guide frames are located on the opposite sides of the power swivel. The wheels that contact the support guides can be made of rubber selected from the group consisting of non-segmented rubber, a rubber composite, a synthetic rubber, and combinations of these.

The rubber wheels are adapted to dissipate the torque created by the power swivel. The wheels align the power swivel with the support guide. Generally the wheels have no tread. In an embodiment of the wheels the axels supporting the wheels can be moved up and down to adjust a wheel, two wheels, or all four wheels.

The traveling swivel frame assembly has two pairs of traveling sheaves (200*a* and 200*b*). The wheels (212*a*, 212*b*, 212*c*, 212*d*) include mounting points. The rubber wheels lessen the vibration on the entire drilling unit preventing additional wear on the parts of the system. The top drive unit (220) is attached to the traveling swivel frame assembly at the first and the second load structures (206*a* and 206*b*). Pins (208*a* and 208*b*) are used to attach the top drive unit (220) to the first and the second load structures (206*a* and 206*b*). A first cobra hook (210*a*) is attached to the first guide frame (204*a*) using fastener (208*c*) and the second cobra hook (210*b*) is attached to the second guide frame (204*b*) using fastener (208*d*). The fasteners can be pins, such as 2½ inch to 3 inch diameter pins. One pin can be used on each side of the top drive (220) to affix the top drive (220) to the load structure. Elevator links are attached to the hooks. The elevator links are used to lift drill pipe, drill casing, drilling collars, and other drilling items from a horizontal position as they are stored into a vertical position for drilling. Holes in the frame can be used to access the wheels.

Figure 2:
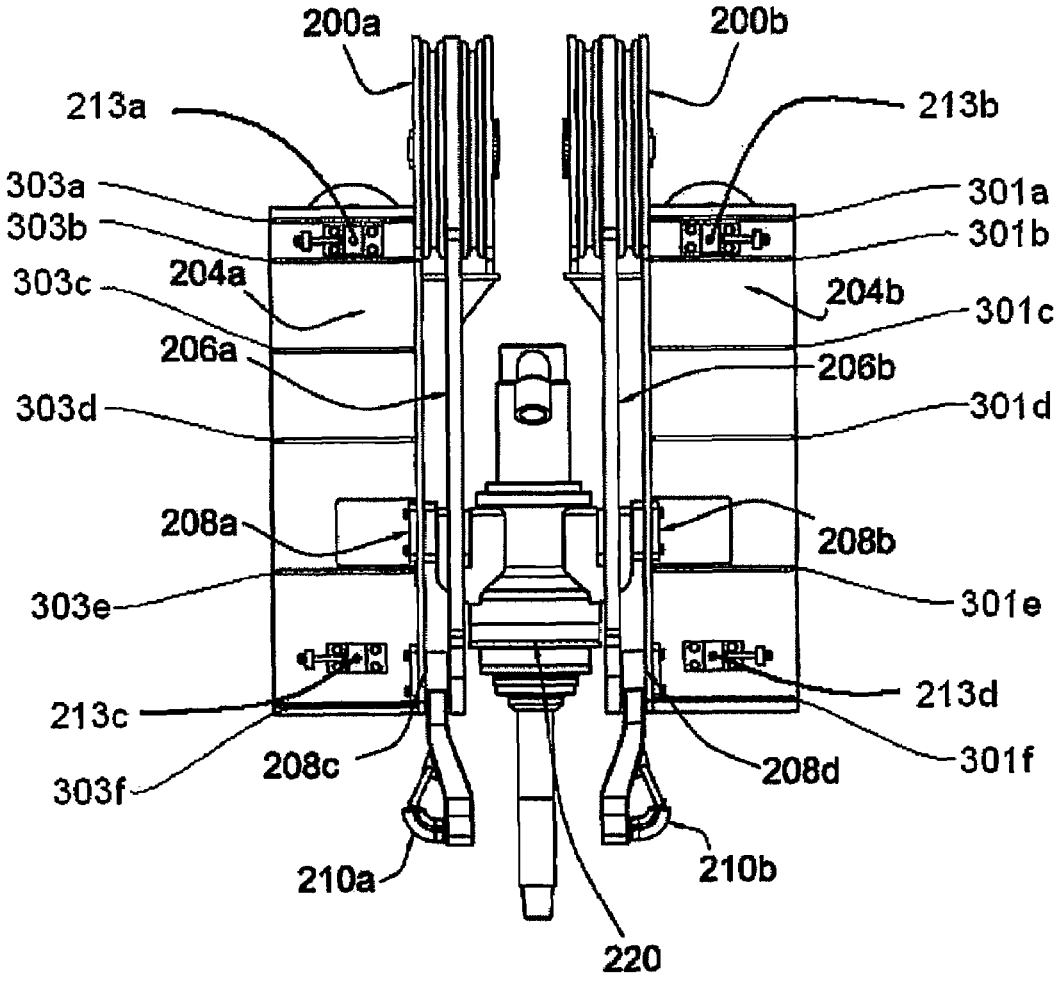
FIG. 2 depicts a cross sectional detailed view of the traveling swivel frame assembly.

FIG. 2 shows the opposite side of the traveling swivel frame assembly depicted in FIG. 1. The traveling swivel frame assembly has guide frames (204*a* and 204*b*) the first guide frame (204*a*) has stiffeners (303*a*, 303*b*, 303*c*, 303*d*, 303*e*, 303*f*). The second guide frame (204*b*) has stiffeners (301*a*, 301*b*, 301*c*, 301*d*, 301*e*, 301*f*). The stiffeners (301*a*, 301*b*, 301*c*, 301*d*, 301*e*, 301*f*, 303*a*, 303*b*, 303*c*, 303*d*, 303*e*, 303*f*) are adapted to strengthen the guide frame and resist torque created by the power swivel. The guide frames (204*a* and 204*b*) are used to mount the wheels. The wheels (212*a*, 212*b*, 212*c*, 212*d*) are connected in pairs using a fixed length axel. The fixed length axel is attached to the guide frame. Two wheels per side of the traveling swivel frame are contemplated as being ideal.

Figure 3:
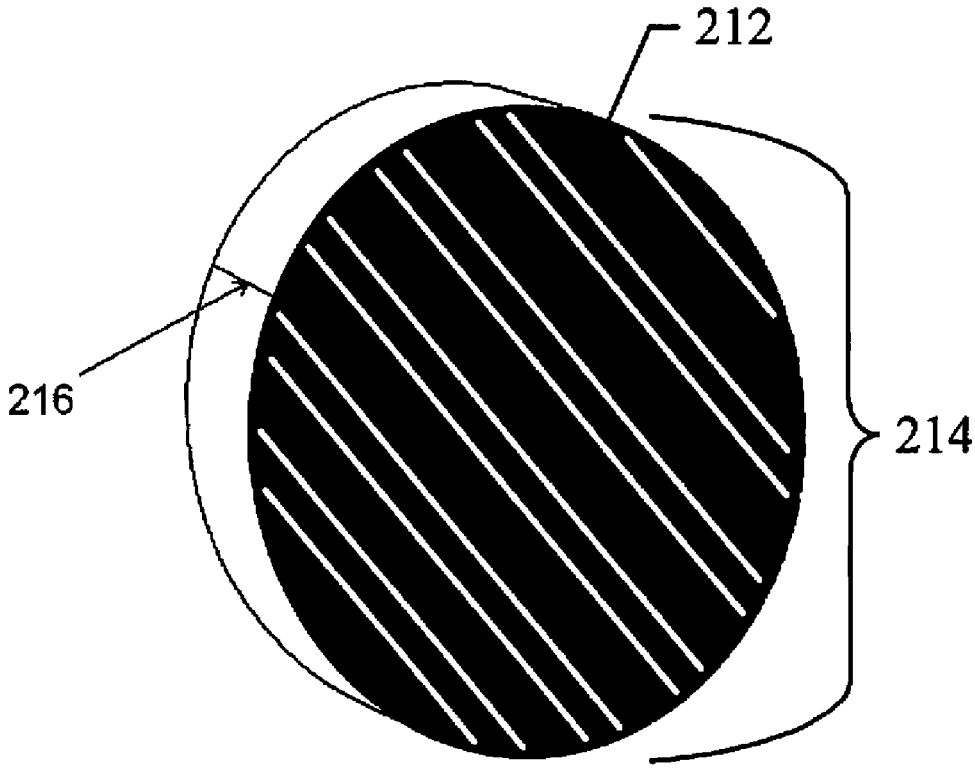
FIG. 3 depicts a perspective view of a wheel usable for the traveling swivel frame assembly.

FIG. 3 depicts a perspective view of the wheels usable in the embodiments. The wheel (212) has a diameter (214) and a width (216). The diameter of the wheels can be larger than 10 inches. The wheels can be attached to the first load structure and the second load structure.

Figure 4:
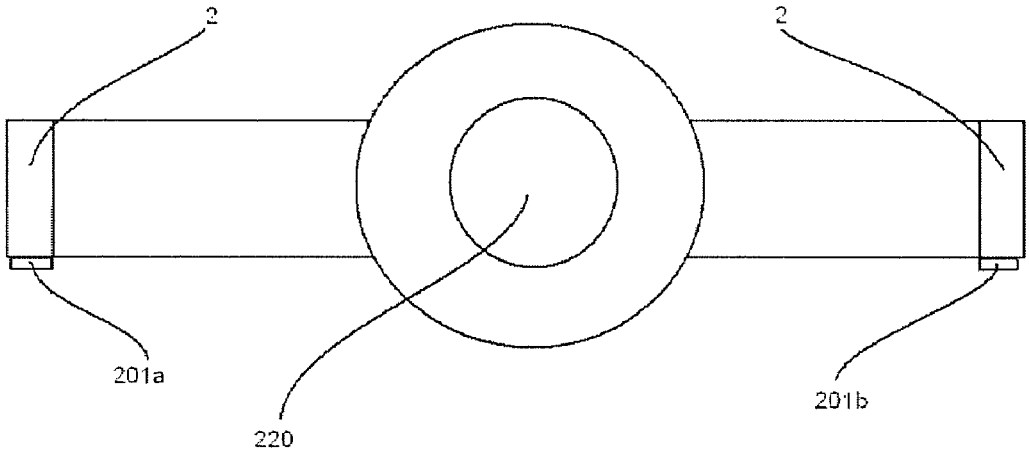
FIG. 4 depicts a top view of the guide frame retainer plate.

FIG. 4 depicts a first guide retainer plate (201*a*) and a second guide retainer plate (201*b*). The guide retainer plates can be located over a support guide and are removable from the support guide. The plate is adapted for the removal of the top drive unit (220) from the support guide. The support guide can be a rail.

The guide retainer plate can be used to remove the traveling swivel frame quickly. The traveling swivel frame can be removed by first removing the guide retainer plate along the driller's side and, then, rotating the guide to clear the leg of the mast. Once the guide is clear of the mast the top drive unit can be laterally displaced. The method ends by removing the swivel pins of the top drive to separate the components for maintenance.

Figure 5:
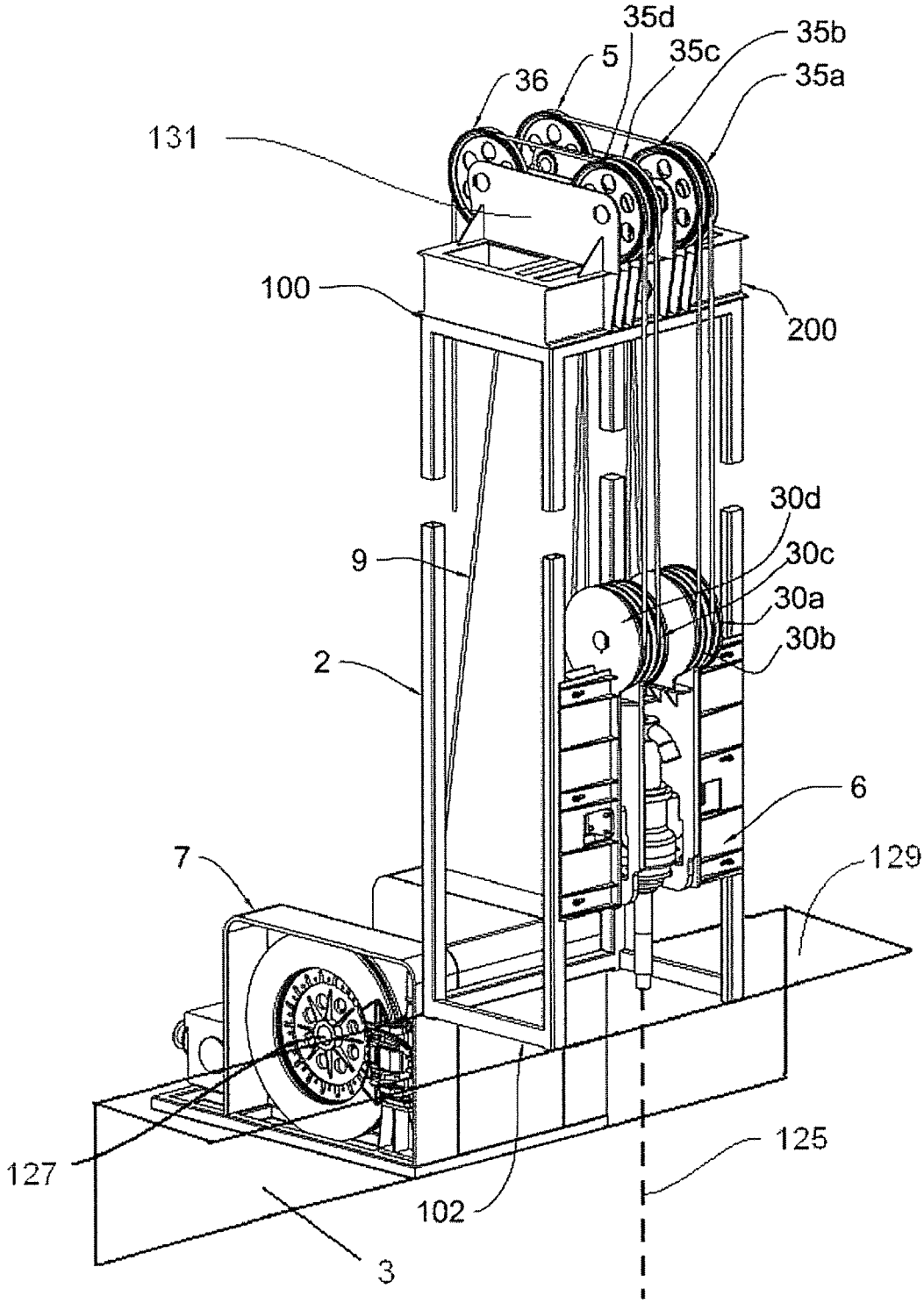
FIG. 5 depicts a perspective view of a machine for earth drilling.

FIG. 5 depicts a top drive earth drilling machine, namely, a top drive drilling rig for drilling oil wells, natural gas wells, water wells or other holes in the earth. The embodiment of the rig depicted in this Figure incorporates a lightweight transport feature that allows the use of the rig to be extended to offshore platforms for offshore drilling. The drilling equipment can be used to drill holes in the earth for construction applications.

FIG. 5 depicts a mast (2) having a mast top (100) and mast bottom (102). The mast bottom is mounted to a substructure (3) connected to a drilling floor (129). The mast can be mounted to a drilling floor (129).

The substructure can be moveable, such as with a truck, a trailer, a barge, or an offshore platform. Alternatively, the substructure can be stationary, such as a steel frame embedded in the earth. The only connection between the mast and the substructure may be a drilling line.

The mast is a device that supports the hoisting mechanism. The mast can serve to guide the traveling swivel frame assembly. In one embodiment, the mast is a tubular mast. In another embodiment, the mast can be a derrick where the two front legs of the derrick support and/or guide the traveling swivel frame assembly. In supporting the traveling swivel frame assembly, the mast can provide a stabilizing force to support the torque applied to traveling swivel frame assembly by a top drive unit.

In another embodiment, the mast is designed to support at least 300,000 pound loads. As an example, the mast can have a height ranging from 50 feet to 140 feet; in an embodiment the mast is a 66-foot single piece mast. Other examples of the mast height are 96 feet and 112 feet. The mast can be free standing without guide wires. The mast can be modular and can be assembled at a site. The masts can made from steel, aluminum or alloys thereof. The use of aluminum results in reduced weight of the drilling rig structure.

Additionally, a crown block assembly (200) is mounted on the mast top for receiving and conveying a drilling line (9). The drilling line can be a wire rope or steel cable with a diameter ranging from 1-inch to 1⅛ inches. An example of a drilling line is Flex-X-9™ available from Wire Rope Corporation of America of Missouri.

The sheaves are wheels or pulleys that allow cable, wire rope, or other type of flexible drilling line to run through. The drilling line (9) travels along any portion of the circumference of the sheave without coming off of the sheave. An example of a sheave is a McKissick sheave available from Crosby Group of Tulsa, Okla. The sheaves are used to change the direction of the drilling line and can each rotate around an axis.

Continuing with FIG. 5, the crown block assembly can have four front sheaves (35*a*, 35*b*, 35*c*, and 35*d*). The crown block assembly (200) has a frame (131) for attaching a fast line sheave, a dead line sheave, and the front sheaves to the crown block assembly (200). In other embodiments, fewer or more than four front sheaves can be used depending on the hoisting capacity of the top drive earth drilling machine. Alternatively, the four front sheaves can each be two pairs of sheaves.

A traveling swivel frame assembly (6) embodied in FIG. 5 has four traveling sheaves (30*a*, 30*b*, 30*c* and 30*d*) mounted to the mast (2). The traveling swivel frame assembly runs vertically along the vertical axis (125) that extends from the mast top (100) to the mast bottom (102).

The top drive earth machine includes a fast line sheave (5) mounted to the crown block assembly (200) for reeving the drilling line (9). The first front sheave (35*a*) transfers the drilling line (9) from the fast line sheave (5) to the first traveling sheave (30*a*). The first traveling sheave (30*a*) transfers the drilling line (9) to the second front sheave (35*b*). The second front sheave (35*b*) transfers the drilling line (9) to the second traveling sheave (30*b*). The second traveling sheave (30*b*) transfers the drilling line (9) to the cross over sheave (31) as shown in FIG. 6.

The cross over sheave (31) transfers the drilling line (9) to the third traveling sheave (30*c*) and the third traveling sheave transfers the drilling line (9) to the third front sheave (35*c*). The third front sheave (35*c*) transfers the line to the forth traveling sheave (30*d*) and the forth traveling sheave (30*d*) transfers the drilling line (9) to the forth front sheave (35*d*). The forth front sheave (35*d*) transfers the drilling line (9) to the dead line sheave (36).

Figure 6:
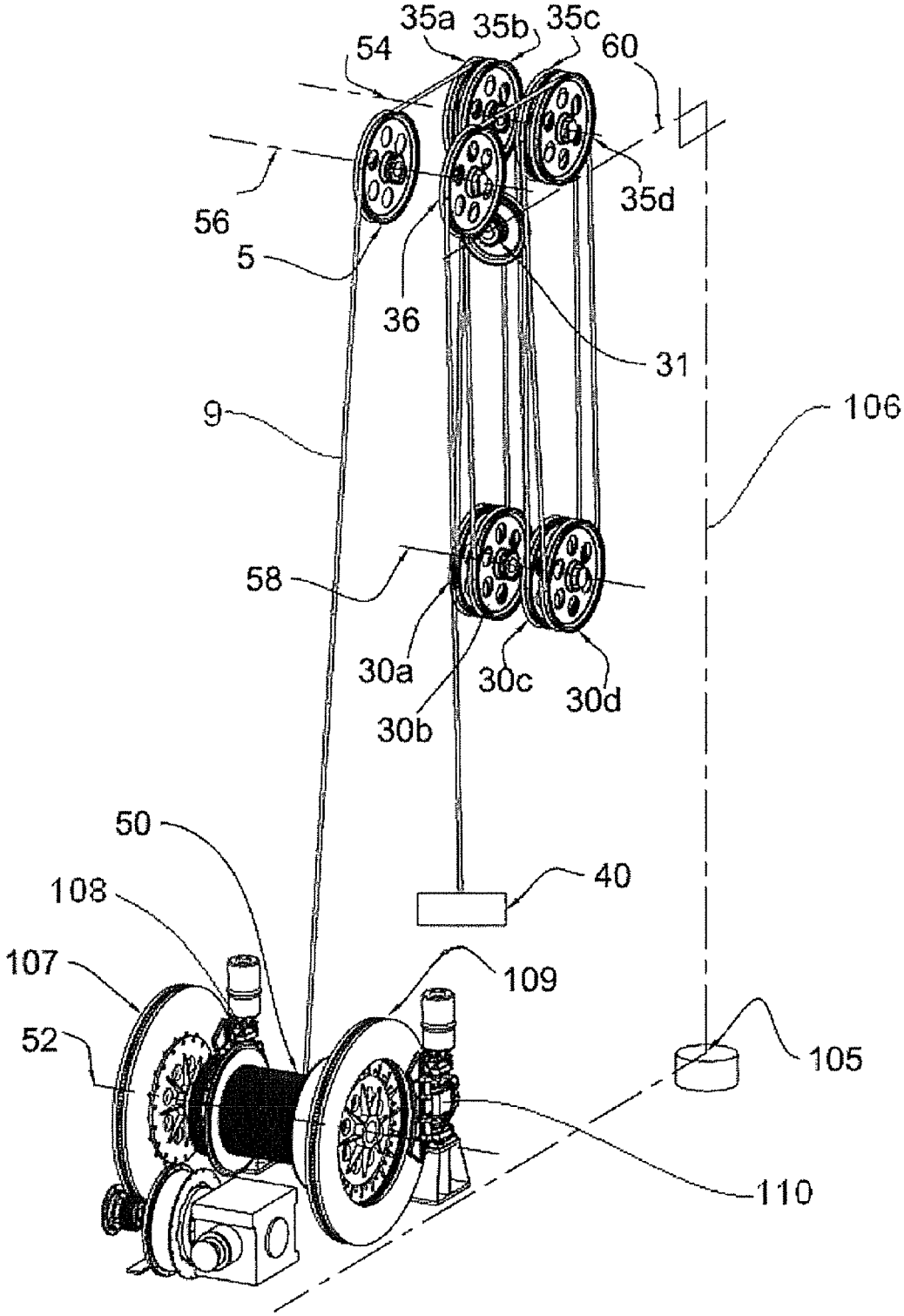
FIG. 6 depicts a perspective view of the path of the drilling line.

FIG. 6 depicts the drawworks assembly (7) attached to the substructure (3). The drawworks has a drive shaft (127) in the center of the drawworks drum (50). The drawworks assembly that is a drawworks drum with brake and disc assembly having a capacity of 500 Horsepower (hp). The drawworks assembly has an air clutch and a controller to operate the drawworks. The drawworks is fixed to the substructure.

The drawworks drum (50) has a width with a midpoint equal to one half of the width of the drum. The midpoint of the drawworks drum assembly is aligned with the midpoint of the fast line sheave, so that a maximum angle of less than 15 degrees is created by the drilling line and the fast line sheave are the same when the drilling line is at the edge of the drawworks drum.

The first traveling sheave (30*a*) of the traveling swivel frame assembly receives the drilling from the first front sheave (35*a*). A second front sheave (35*b*) is mounted to the crown block assembly for transferring the drilling line from the first traveling sheave (30*a*) to the second traveling sheave (30*b*).

For safety reasons, the cross over sheave preferably has a diameter of twenty times the drilling line diameter to accommodate many sizes of the traveling swivel frame assembly and to minimize drilling line stress. The diameter of all of the sheaves is at least twenty times larger than the diameter of the drilling line. The deadline sheave, the first front line sheave, the second front line sheave, the third front line sheave, and the forth front line sheave can each have a diameter thirty times larger than the diameter of the drilling line.

Returning to FIG. 6, a first front sheave (35*a*) transfers the drilling line (9) from the fast line sheave (5) to the first traveling sheave (30*a*). The first traveling sheave (30*a*) transfers the drilling line (9) to the second front sheave (35*b*). The second front sheave (35*b*) transfers the drilling line (9) to the second traveling sheave (30*b*). The second traveling sheave (30*b*) transfers the drilling line (9) to the cross over sheave (31). The cross over sheave (31) receives the drilling line (9) from the second traveling sheave (30*b*). The third traveling frame sheave (30*c*) receives the drilling line (9) from the crown cross over sheave (31).

A third front sheave (35*c*) receives the drilling line (9) from the third traveling frame sheave (30*c*) and a fourth traveling frame sheave (30*d*) receives the drilling line (9) from the third front sheave (35*c*). The fourth front sheave (35*d*) receives the drilling line from the fourth traveling frame sheave (30*d*) and the deadline sheave (36) receives the drilling line from the fourth front sheave (35*d*) and transfers the line to a deadline anchor (40).

FIG. 6 shows the drawworks drum (50) is with a drum axis (52). The width of the drawworks drum is such that the drilling line and the fast line sheave do not create an angle of 15 degrees or more regardless of where the drilling line is on the drawworks drum. The front sheaves (35*a*, 35*b*, 35*c*, and 35*d*) are all aligned on a front axis (54). The fast line sheave and the deadline sheave are both aligned on a back axis (56). The traveling frame sheaves (30*a*, 30*b*, 30*c*, and 30*d*) are each mounted on the traveling frame with a traveling frame axis (58). The front axis, back axis, and traveling frame axis are parallel to the drum axis. The cross over sheave defines a cross over axis (60) and the cross over axis creates an angle with the drum axis (52) that is perpendicular or about 90 degrees.

The cross over axis (60) can be parallel to the ground and is perpendicular to a well bore vertical axis (106) extending from the well bore (105).

Additionally, the drawworks assembly can comprise two air operated caliper brakes (108 and 110) for slowing or stopping the rotation on the drawworks drum. The air operated calipers are mounted to the drawworks assembly with an air cooled disc installed on the drawworks drum. The disks for the air operated caliper brakes are preferably a size of 60 inches in diameter. This size allows the brakes to cool themselves adequately with the surrounding air and does not require a secondary cooling system. An example of the brakes can be obtained from Kobelt, of Vancouver, Canada. The brakes can have air cooled discs (107 and 109). Air cooled breaks are much more cost effective than water cooled breaks that require associated piping to carry water to and from the breaks. The caliper system eliminates the need of a water cooled auxiliary braking system for lowering of the traveling assembly. A specifically sized main drum along with the placement of the drawworks eliminates any side load on the fast line sheave, thereby reducing the wear and stresses on the drilling line and the sheaves and reducing the loads on the drum and the sheave bearings.

The caliper brakes are operated with an air operating system. The caliper break reduces most of the force needed to operate a manual brake handle because the air operated valves only require minimum effort to operate the caliper brakes. The caliper brakes eliminate the need to adjust the brake bands or any linkages.

Figure 7:
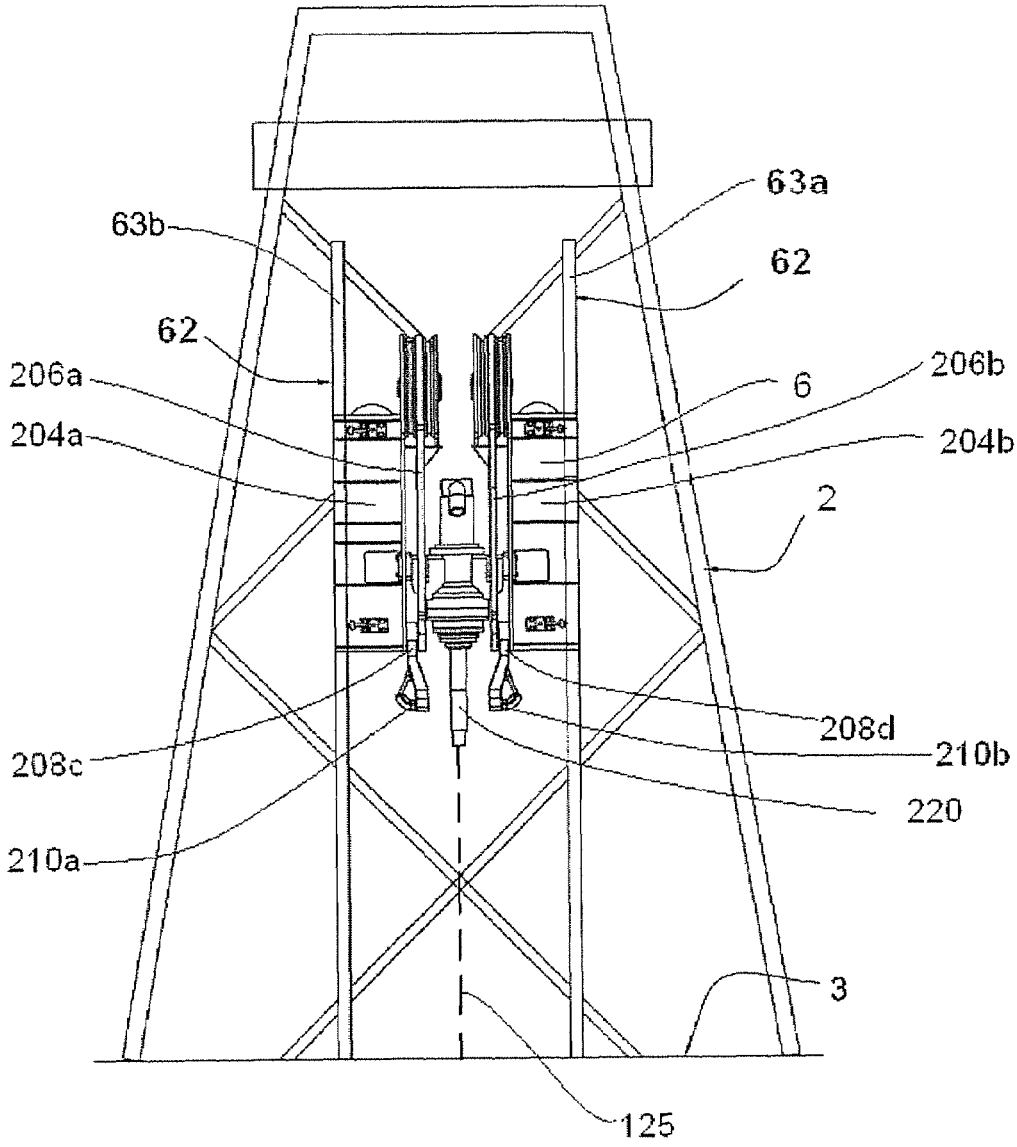
FIG. 7 depicts a cross sectional view of a derrick with a support guide.

FIG. 7 depicts a mast (2) attached to the substructure (3) with a support guides (62) for guiding the vertical motion of the traveling swivel frame assembly (6). The support guides (62) can be attached to the substructure (3). Alternatively, the support guides (62) can be attached only to the mast (2) and not be in contact with the substructure (3).

In one embodiment, the support guides (62) are a pair of rails (63*a* and 63*b*) attached to the front side of a mast. In another embodiment, the rails do not engage the substructure and are only used for guiding the vertical movement of the traveling swivel frame assembly. The rails (63*a* and 63*b*) are preferably made of square or rectangular steel tubing. In supporting the traveling swivel frame assembly, the support guides provide a stabilizing force to support the torque applied to traveling swivel frame assembly by a top drive unit to allow the torque to be applied to the drilling pipe. Alternatively, the support guide (62) can comprise a single rail. A top drive unit (220) is shown in FIG. 7 attached to the traveling swivel frame assembly (6).

The top drive (220) is attached to the traveling swivel frame assembly at the first and the second load structures (206*a* and 206*b*). The top drive unit is made up of a power frame and the load structure. A first hook (210*a*) is attached to the first load structure and the second hook (210*b*) is attached to the second load structure. Elevator links are attached to the hooks. The elevator links are used to lift drill pipe, drill casing, drilling collars, and other drilling items from a horizontal position as they are stored into a vertical position for drilling. Pins (208*c* and 208*d*) are used to attach the hooks to the guide frame (204*a* and 204*b*). The addition of the hooks allows the traveling swivel frame assembly to be used as a hoisting block without the need for additional sets of hoisting blocks.

Continuing with FIG. 7, the mast (2) is depicted as a derrick and the traveling swivel frame assembly is mounted to a support guide (62). The traveling swivel frame assembly can move in a vertical direction along a vertical axis (125).

Fasteners are used to attach the power swivel to the first and the second load structures to form the top drive. The fasteners can be pins, such as 2-12 inch to 3 inch diameter pins. One pin can be used on each side of the top drive (220) to affix it to the load structure.

A first hook (210*a*) is attached to the first load structure and a second hook (210*b*) is attached to the second load structure. The hooks enable additional pipe or casing, or pipe elevator links to be secured to the traveling swivel frame assembly allowing the traveling frame to be used as a conventional set of hoisting blocks, thereby eliminating the need for an extra crane or other hoisting equipment with the drilling rig, thereby reducing the cost of repair and enabling a smaller sized rig to drill with the loads of larger rigs.

The hooks can be the type known as "cobra hooks" that are available from Venture Tech of Houston, Tex. Ultra sturdy and strong snap shackles with extended metal shafts are usable herein, wherein the shaft accommodates a second set of pins (208*c* and 208*d*) to engage the traveling swivel frame assembly. Snap shackles can be custom made with a shaft about 1-2 feet long and a snap shackle diameter of about 10 inches. The snap shackle preferably opens and closes with an upper and a lower bolt. The hooks can be used to pickup drill pipe, drill collars, fishing tools, drill casing, and other drill rig parts.

Figure 8:
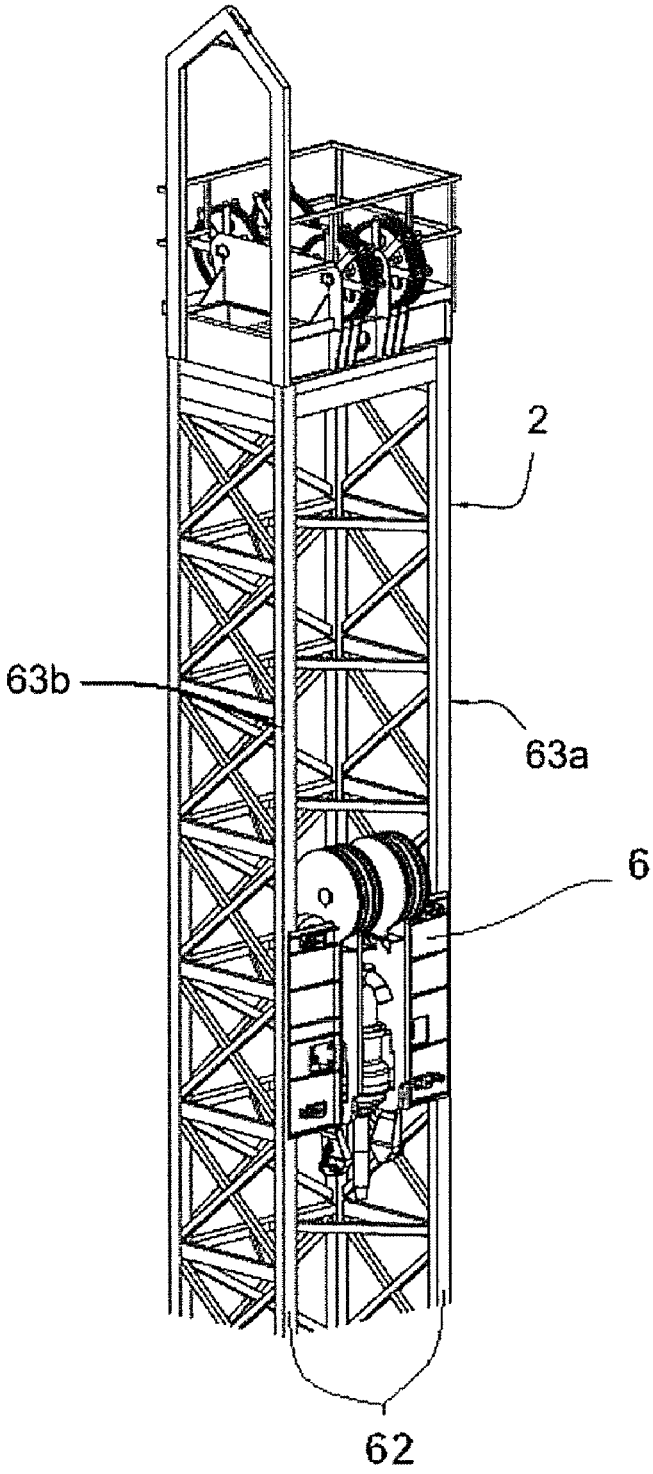
FIG. 8 depicts a cross sectional detailed view of the traveling swivel support.

FIG. 8 depicts an alternative mast (2) to the mast depicted in FIG. 7. The mast (2) can have a support guide (62) for guiding the vertical motion of the traveling swivel frame assembly (6). In a preferred embodiment, the support guide (62) is a pair of rails (63*a* and 63*b*) attached to the front side of a mast. The rails are only used for guiding the vertical movement of the traveling swivel frame assembly. The rails are preferably made of square or rectangular steel tubing.

While these embodiments have been described with emphasis on the preferred embodiments, it should be understood that within the scope of the appended claims, the embodiments might be practiced other than as specifically described herein.

What is claimed is:

1. A guiding system for a top drive unit for aligning a power swivel and dissipating torque created by the power swivel, wherein the power swivel rides on a support guide on a derrick, wherein the guiding system comprises:

a first guide frame and a second guide frame, wherein the first guide frame and second guide frame are located on opposite sides of the power swivel;

wherein the first guide frame comprises a first wheel and a second wheel, wherein the second guide frame comprises a third wheel and a fourth wheel, wherein each wheel is adapted to dissipate torque created by the power swivel and align the power swivel to a support guide, wherein each wheel is selected from the group consisting of a hard segmented rubber wheel, a non-segmented rubber wheel, a rubber composite wheel, a synthetic rubber wheel, and combinations thereof;

wherein the first wheel and the second wheel are connected by a first fixed length axel, and wherein the third wheel and the fourth wheel are connected by a second fixed length axel, which position the wheels in relation to the support guide;

a first housing enclosing the first fixed length axel, the first wheel, and the second wheel; and a second housing enclosing the second fixed length axel, the third wheel, and the fourth wheel.

2. The guiding system of claim 1, wherein each wheel comprises a diameter of larger than 10 inches.

3. The guiding system of claim 1, wherein each guide frame further comprises a plurality of stiffeners disposed horizontally on the guide frame, wherein the stiffeners are adapted to strengthen the guide frame and resists torque created by the power swivel.

4. The guiding system of claim 1, wherein each guide frame further comprises a removable guide retainer plate located over the support guide, wherein the removable guide retainer plate is adapted to allow for removal of the top drive unit from the support guide.

5. The guiding system of claim 1, wherein the support guide is a rail or a derrick leg.

* * * * *